US008912973B2

(12) United States Patent
Werner et al.

(10) Patent No.: US 8,912,973 B2
(45) Date of Patent: Dec. 16, 2014

(54) ANISOTROPIC METAMATERIAL GAIN-ENHANCING LENS FOR ANTENNA APPLICATIONS

(75) Inventors: Douglas H. Werner, State College, PA (US); Erik Lier, Newton, PA (US); Bonnie G. Martin, Lumberton, NJ (US); Jeremiah P. Turpin, State College, PA (US); Qi Wu, State College, PA (US)

(73) Assignees: The Penn State Research Foundation, University Park, PA (US); Lockheed Martin Corporation, Denver, CO (US)

( * ) Notice: Subject to any disclaimer, the term of this patent is extended or adjusted under 35 U.S.C. 154(b) by 350 days.

(21) Appl. No.: 13/464,492

(22) Filed: May 4, 2012

(65) Prior Publication Data

US 2012/0280872 A1 Nov. 8, 2012

Related U.S. Application Data

(60) Provisional application No. 61/482,402, filed on May 4, 2011.

(51) Int. Cl.

| | |
|---|---|
| ***H01Q 21/00*** | (2006.01) |
| ***H01Q 15/02*** | (2006.01) |
| ***H01Q 19/06*** | (2006.01) |
| ***H01Q 15/00*** | (2006.01) |

(52) U.S. Cl.

CPC ..... *H01Q 15/02* (2013.01); *H01Q 19/062* (2013.01); *H01Q 15/0053* (2013.01)

USPC ..... 343/853; 343/909; 343/810

(58) Field of Classification Search

CPC .. H01Q 15/0053; H01Q 19/062; H01Q 15/02

See application file for complete search history.

(56) References Cited

U.S. PATENT DOCUMENTS

| | | | | |
|---|---|---|---|---|
| 6,791,432 | B2 * | 9/2004 | Smith et al. | 333/99 S |
| 6,985,118 | B2 | 1/2006 | Zarro et al. | |
| 7,271,769 | B2 * | 9/2007 | Asano et al. | 343/702 |
| 7,365,701 | B2 | 4/2008 | Werner et al. | |
| 7,522,124 | B2 * | 4/2009 | Smith et al. | 343/909 |
| 7,623,745 | B2 | 11/2009 | Podolskiy et al. | |
| 7,710,336 | B2 | 5/2010 | Schweizer et al. | |
| 7,864,394 | B1 | 1/2011 | Rule et al. | |
| 2001/0038325 | A1 * | 11/2001 | Smith et al. | 333/202 |
| 2009/0096545 | A1 | 4/2009 | O'Hara et al. | |

(Continued)

FOREIGN PATENT DOCUMENTS

EP 2458396 A1 5/2012

OTHER PUBLICATIONS

Goussetis, G., et al., "Periodically loaded dipole array supporting left-handed propagation," IEE Proc.—Microw. Antennas Propag., 152(4), 251-254, Aug. 2005.

(Continued)

*Primary Examiner* — Trinh Dinh

(74) *Attorney, Agent, or Firm* — Gifford, Krass, Sprinkle, Anderson & Citkowski, P.C.

(57) ABSTRACT

Examples of the present invention include metamaterials, including metamaterial lenses, having material properties that approximate the behavior of a material with low (0<n<1) effective index of refraction. Metamaterials may be designed and tuned using dispersion engineering to create a relatively wide-band low-index region. A low-index metamaterial lens created highly collimated beams in the far-field from a low-directivity antenna feed.

14 Claims, 12 Drawing Sheets

(56) References Cited

U.S. PATENT DOCUMENTS

| | | | | |
|---|---|---|---|---|
| 2009/0201221 | A1 | 8/2009 | Werner et al. | |
| 2009/0273538 | A1* | 11/2009 | Smith et al. | 343/909 |
| 2010/0097048 | A1 | 4/2010 | Werner et al. | |
| 2010/0259345 | A1 | 10/2010 | Kim et al. | |
| 2011/0204891 | A1 | 8/2011 | Drake et al. | |
| 2011/0209110 | A1 | 8/2011 | Grbic et al. | |

OTHER PUBLICATIONS

M.J. Freire, R. Marques, L. Jelinek, "Experimental demonstration of a μ = -1 metamaterial lens for magnetic resonance imaging," *Appl. Phy. Lett.*, 93, 231108 (2008).

J.B. Pendry, "Negative refraction makes a perfect lens", *Phys. Rev. Letts.*, 85(18), 3966 (2000).

M.C.K. Wiltshire et al., "Microstructured Magnetic Materials for RF Flux Guides in Magnetic Resonance Imaging," *Science*, 291, 849 (2001).

M.J. Freire, R. Marques, "Planar magnetoinductive lens for three-dimensional subwavelength imaging," *Appl. Phys. Lett.*, 86, 182505 (2005).

M. Lapine, M. Jelinek, M.J. Freire, R. Marques, "Realistic metamaterial lenses: Limitations imposed by discrete structure, " *Physical Review B*, 82, 165124 (2010).

Z.H. Jiang et al., "An Isotropic 8.5 MHz Magneti mega-lens", *IEEE International Symposium on Antennas and Propagation* (*APSURSI*), 1151-1154 (2011).

C.P. Scarborough, "Experimental demonstration of an isotropic metamaterial super lens with negative unity permeability at 8.5 MHz", *Applied Physics Letters*, 101(1), 2, (2012).

* cited by examiner

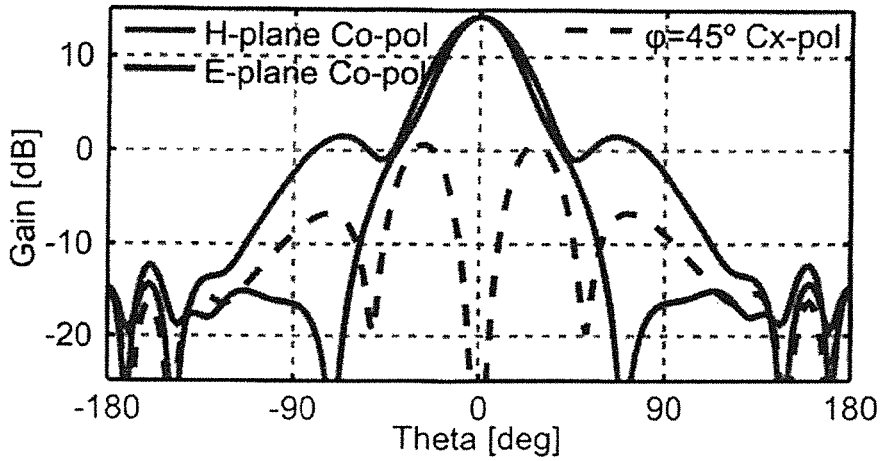
(a)
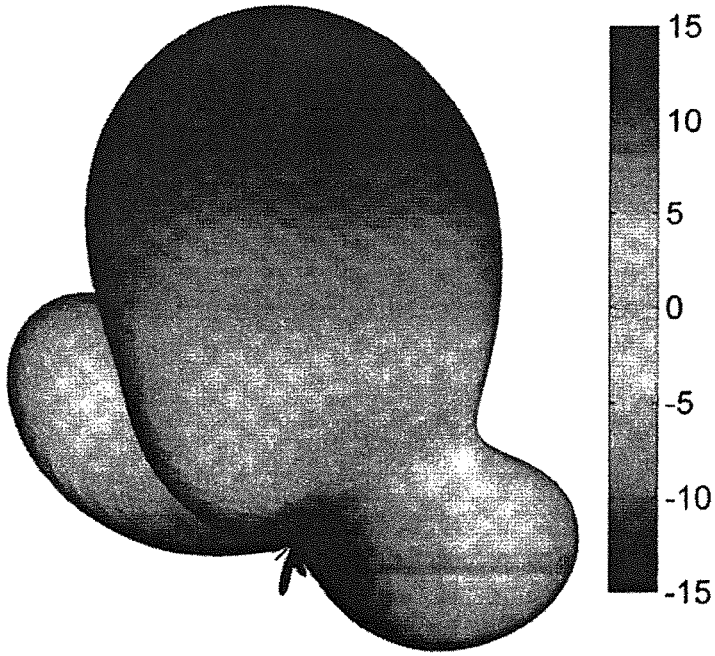
(b)
FIGS 14A - B

ANISOTROPIC METAMATERIAL GAIN-ENHANCING LENS FOR ANTENNA APPLICATIONS

REFERENCE TO RELATED APPLICATION

This Utility patent application claims priority to U.S. provisional patent application Ser. No. 61/482,402, filed May 4, 2011, the content of which is incorporated herein in its entirety.

FIELD OF THE INVENTION

The invention relates to metamaterials, for example to metamaterials lenses in antenna systems.

BACKGROUND OF THE INVENTION

The maximum possible gain of a conventional aperture antenna is determined by the size of the aperture. Hence, dish reflectors, horn antennas, array antennas and other electrically large antennas may have large gain due to their large aperture area. However, many applications would benefit from small antenna sizes, and approaches to improving antenna gain without increasing antenna size or weight would be extremely useful for a variety of applications.

SUMMARY OF THE INVENTION

Examples of the present invention include anisotropic low-index metamaterials used as a far-field collimating lens. Example uniaxial metamaterials have low values (e.g. <1) for both $\in_z$ and $\mu_z$, producing 3D collimated beams. For a planar metamaterial lens, z is a surface normal to a lens face. A balanced response to both dipoles may be obtained by configuring the metamaterial such that $\in_z=\mu_z$, $\in_T=\mu_T$.

An example metamaterial uses dual-split ring resonators (DSRR) in the x-y plane for a low permeability response, and end-loaded dipole (ELD) elements in the x-z and y-z planes for a low permittivity response. As $\in_z$ or $\mu_z$ approaches zero, the pass-band narrows, improving collimation and directivity of the antenna. Applications include a high-gain, low-profile circularly-polarized antenna. Apparatus according to examples of the present invention include a high-gain, low-profile circularly-polarized antenna including a metamaterial lens.

Examples of the present invention include an anisotropic low-index metamaterial used as a far-field collimating lens for an antenna feed, such as a dual-polarization crossed-dipole antenna feed. The metamaterial may be uniaxial, having low values for both $\in_z$ and $\mu_z$ that produce 3D collimated beams. An example method of improving the directivity of an antenna, in particular a circularly polarized antenna, includes passing radiation transmitted or received by the antenna through a metamaterial lens according to an example of the present invention.

Example apparatus include a metamaterial, such as a planar metamaterial which may be used as a lens. Split-ring resonators are disposed in a first plane, and end-loaded dipoles are disposed in at least one plane perpendicular to the first plane. A uniaxial planar metamaterial include split-ring resonators disposed in a first plane parallel to the faces of the planar metamaterial, and end-loaded dipoles disposed in two perpendicular planes including a surface normal. The split-ring resonators may be configured to give a low permeability, and may be dual-split ring resonators. The end-loaded dipoles may be configured to give a low permittivity.

An example planar metamaterial extending within a metamaterial plane includes an array of dual-split ring resonators (DSRR) in the metamaterial plane (parallel to the lens face, denoted the x-y plane in some examples below), and end-loaded dipoles disposed in the x-z plane and/or the y-z plane, perpendicular to the x-y plane, where z is a surface normal. The metamaterial may include an arrangement, such as a lattice, of planar dielectric substrates. The metamaterial may be uniaxial, the axis of uniaxiality being parallel to the surface normal (z-direction). For a slab lens having planar faces, the z-direction is perpendicular to the lens faces. A dielectric substrate may be a generally planar rigid dielectric sheet, such as those used for printed circuit boards, including high frequency laminates.

Example apparatus include an antenna, for transmission and/or reception of radiation, including the planar metamaterial and an antenna feed, the planar metamaterial being a metamaterial lens for the antenna feed. The antenna feed may be a dual-polarization crossed-dipole antenna feed, and the antenna may be a circularly polarized antenna.

An example metamaterial has values of both $\in_z$ and $\mu_z$ that are both less than 1, $\in_z$ being a permittivity along a z-direction normal to the input and output faces of the planar metamaterial, and $\mu_z$ being a permeability along the z-direction. The metamaterial may be anisotropic, such as uniaxial. Here, $\mu_z$ be obtained using a resonant structure including a ring resonator, such as a dual-split ring resonator. Also, $\in_z$ may be obtained using a resonant structure including an end-loaded dipole.

A novel metamaterial may comprise a repeated unit cell structure, the unit cell structure including an end-loaded dipole. An end-loaded dipole (ELD) may be used to realize a low permittivity electrically active material, and providing four vertical ELD elements on adjacent sides of a cube/cuboid unit cell creates a volumetric ELD (VELD), useful for producing a uniaxial permittivity. A cubic metamaterial unit cell may comprise two split-ring resonators (on upper and lower faces) and four ELD structures arranged as a VELD. A metamaterial according to an example of the present invention includes a plurality of VELDs, for example formed by orthogonal intersecting arrays of ELDs. Split ring resonators and ELDs may be formed by etching a metal-coated dielectric substrate, for example using printed circuit board techniques.

Example apparatus include a metamaterial lens having an operating frequency, having parallel and spaced apart lens faces, the metamaterial including split-ring resonators disposed parallel to the lens faces, and end-loaded dipoles disposed in at least one plane perpendicular to the lens faces. An example metamaterial lens is a slab lens, having first and second planar faces, spaced apart by the lens thickness, and having length side lengths that may or may not be equal, so the lens may have square or rectangular faces. The lens side lengths are greater than the lens width. The lens faces may be provided by dielectric substrates used to support arrays of split ring resonators. There may optionally be one or more additional dielectric substrate located between the lens faces, also used to support arrays of split-ring resonators, the dielectric layers used to support split ring resonators being spaced apart and parallel. The split-ring resonators may dual-split ring resonators, having two gaps in a conducting loop. Further dielectric substrate are used to support arrays of end-loaded dipoles (ELDs), and these substrates are arranged in a three-dimensional intersecting pattern. One group of dielectric substrates is used to support the ELDs are arranged perpendicular to the lens faces, and may be parallel to the first edge of a slab lens. Another group of dielectric substrates supporting ELDs, are arranged intersecting the first group, and also perpendicular to the lens faces. The lens may be a microwave lens, radar lens, or other electromagnetic lens.

An end-loaded dipole may include a conducting track, such as a linear conducting portion having a first end and a second end, a first sinuous end-loading arm electrically connected to the first end, and a second sinuous end-loading arm electrically connected to the second end. The linear portion and sinuous end-loading arms may be formed as a single uninterrupted conducting track.

End-loaded dipoles may be configured to have a permittivity of less than 1 at the operating frequency of the lens, i.e. for electromagnetic radiation having the operating frequency. The split ring resonators and end-loaded dipoles are configured so that the metamaterial lens has a permittivity $\in_z$ and a permeability $\mu_z$ at the operating frequency, where $\mu_z$ is the permeability along a direction normal to the lens faces, $\in_z$ is the permittivity along a direction normal to the lens faces, and $\in_z$ and $\mu_z$ are both less than 1, such as between 0 and 1 (inclusive), for example between 0 and 0.5, and in some examples between 0 and 0.3.

A repeated cubic structure (such as a unit cell) of the metamaterial, or cube formed by intersecting dielectric substrates, may include split-ring resonators (such as a DSRR) on a pair of opposed faces of the cubes, and ELDs on the remaining four faces of the cube. Such an arrangement of ELDs may be referred to as a volumetric ELD, or VELD. The apparatus of claim 1, the apparatus comprising a three-dimensional arrangement of dielectric substrates supporting the split-ring resonators and the end-loaded dipoles, the split-ring resonators and the end-loaded dipoles being conducting patterns formed on the dielectric substrates. A three-dimensional arrangement of dielectric substrates may a plurality of hollow dielectric cubes, a dielectric cube supporting a pair of split ring resonators on opposed faces of the dielectric cube, and end-loaded dipoles on the remaining faces of the dielectric cube. The split ring resonators and end-loaded dipoles may be supported on the interior and/or exterior surfaces of the dielectric cube.

The operating frequency of the lens may be in the range 1 GHz-100 GHz, in some examples in the range 1 GHz-20 GHz. In some examples, the lens is used as a lens for microwave radiation. The metamaterial lens may be used in a radar apparatus at any frequency conventionally used for radar, including low frequency radar applications. Example apparatus include radar, wireless communication, microwave, or other electromagnetic apparatus such as transmitters and/or receivers including a metamaterial lens. The lens may have a pair of lens faces, for example as input face and an output face of the lens, and the lens faces may be planar, spaced apart, and parallel to each other. An example metamaterial lens includes arrays of dual-split ring resonators, supported by dielectric substrates disposed parallel to the lens faces. Each substrate may support an array of resonators on one or both sides of the substrate. Arrays of end-loaded dipoles are supported by dielectric substrates disposed perpendicular to the lens faces, and also on dielectric substrates disposed perpendicular to both the first and second dielectric substrates.

An example antenna, which may be used to transmit and/or receive electromagnetic radiation includes a ground plane, typically a highly electrically conducting sheet such as a metal sheet, and an antenna feed, such as a dipole, combination of dipoles, or other radiative or receptive element. The ground plane is spaced apart from and parallel to the metamaterial lens, the antenna feed being located between the ground plane and the metamaterial lens. Example lenses appreciably improve the directionality of the antenna. The antenna feed may be a dual-polarization crossed-dipole antenna feed, for example producing circularly polarized radiation. The lens may be configured to have collimating properties independent of rotational of the lens in the plane of the lens face plane.

BRIEF DESCRIPTION OF THE DRAWINGS

FIG. 6A shows a split ring resonator, FIG. 6B shows an end-loaded dipole structure, FIG. 6C shows a volumetric ELD (VELD) structure, FIG. 6D shows a combined magneto-electric SRR-VELD unit cell geometry.

FIGS. 14A-14B show a simulated 2D radiation pattern of a metamaterial lens fed by single x-polarized dipole at 8.3 GHz.

DETAILED DESCRIPTION OF THE INVENTION

Figure 1:
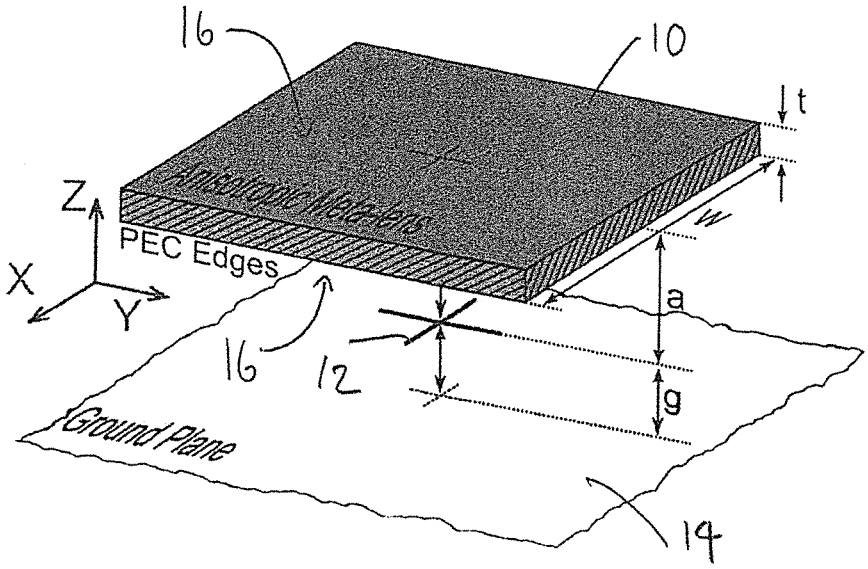
FIG. 1 illustrates a circularly-polarized cross-dipole antenna placed between a metamaterial lens and a ground plane.

Examples of the present invention include metamaterials, including metamaterial lenses having material properties that approximate the behavior of a material with low effective index of refraction n (e.g. $0 \le n \le 1$). Metamaterials may be designed and tuned using dispersion engineering to create a relatively wide-band low-index metamaterial lens, where permittivity and permeability normal to the lens face are less than 1, for example in the range 0-1, inclusive. The term meta-lens is sometimes used as an abbreviation for metamaterial lens, and LIM is sometimes used as an abbreviation for a low index lens. In some examples, the permittivity and permeability normal to the lens face are approximately zero, giving a zero-index metamaterial (ZIM) lens configuration.

An example metamaterial uses dual-split ring resonators (DSRR) in the x-y plane for a low permeability response, and end-loaded dipole (ELD) elements in the x-z and y-z planes for a low permittivity response. As $\in_z$ or $\mu_z$ approaches zero, the pass-band narrows, improving collimation and directivity of the antenna, as shown by full-wave electromagnetic simulations and experimental data. A metamaterial lens using these resonators created highly collimated beams in the far-field, from a low-directivity antenna feed such as a dipole. Example metamaterials were configured for use with microwave radiation, but can be scaled to other frequencies of interest, such as radar frequencies.

Examples of the present invention include collimating lenses including low-index metamaterials (LIMs). A collimating lens, including a thin square slab of uniaxial low-index metamaterial, may be used with a circularly-polarized crossed-dipole antenna feed situated proximate a metallic ground plane, between the lens and the ground plane. The combination of magnetic and electric low-index properties allows far-field collimation of circularly-polarized radiation.

Polarization-independent collimating metamaterial lenses (meta-lenses) were designed, simulated, and successfully fabricated using PCB techniques. Experimental data and simulations both indicated excellent lens performance over a ~10% impedance bandwidth and ~15% pattern bandwidth. A metamaterial lens with equal uniaxial permittivity and permeability can be used with linearly polarized dipole or circularly polarized crossed-dipole antenna feeds. Example metamaterials were designed using both magnetic split-ring resonators (SRRs) and electric end-loaded dipoles (ELDs), combined to produce the desired matched magneto-electric response.

An example metamaterial lens was constructed using PCB technology and the measured radiation patterns showed good agreement with simulated design data for the lens. Increasing the gain and effective aperture size with the lens allows the use of smaller, lighter antenna feeds while obtaining excellent radiation characteristics. Example low-index lens metamaterial designs are compact and light, and suitable for space and aerospace applications, for example by replacing reflector antennas. A meta-lens design only requires a single feed, and is inexpensive and low-loss compared to conventional array beamforming systems. Examples also include lens and feed pairs with wider impedance bandwidth, and metamaterials with multi-band operation.

Gain enhancement may be achieved using dielectric lenses, antenna arrays, reflector dishes, volumetric and end-fire elements, or by increasing the antenna size. However, these approaches generally result in large, bulky, and heavy apparatus. Previous metamaterial and EBG lenses have low operational bandwidth, and may be highly polarization-sensitive. Array antennas have relatively high manufacturing cost, complexity, and high loss. Examples of the present invention allow these problems to be avoided.

Using a thin ZIM/LIM slab lens to spread and collimate the energy from a low-directivity antenna feed increases the effective aperture size of the system, which can fit within a smaller volume than would be required for a more traditional dish antenna for example. A thin slab ZIM can be used as a directivity-enhancing superstrate or lens, the thin lens producing highly-directive radiation while allowing the use of low-cost antennas with simple feed and impedance-matching networks compared to conventional antenna arrays. In this context, a thin lens has a thickness less than the operational wavelength. Example apparatus may be designed for use in space, for example configured for use on a satellite.

The gain of an antenna over an isotropic source is a key metric in the design of a communication system. The maximum gain of a non-volumetric antenna is related to the size of the aperture. Dish reflectors and other electrically large antennas will have large gain due to their large aperture area. For many applications, it is advantageous to obtain increased gain without increasing aperture.

Example apparatus include wideband, resonant metamaterials with operation over 12% bandwidth at 8 GHz, much wider than the 1-3% achieved by earlier metamaterial designs. Hence, example lenses may have a bandwidth of over 10% of the nominal operational frequency. Example metamaterials are light and compact, for example using a hollow printed circuit board (PCB) construction or other dielectric substrate.

Examples include an anisotropic low-index metamaterial configured as a far-field collimating lens, which may be used with a dual-polarization crossed-dipole antenna feed. A balanced response to both dipoles may be obtained using $\in_z=\mu_z$, $\in_T=\mu_T$. Example metamaterials are uniaxial, and have low values for both $\in_z$ and $\mu_z$ that produce 3D collimated beams. Example metamaterials use dual-split ring resonators (DSRR) in the x-y plane for a low permeability response (<1, such as ≤0.5, e.g. ≤0.2, and ≥0), and end-loaded dipole (ELD) elements in the x-z and y-z planes for a low permittivity response (<1, such as ≤0.5, e.g. ≤0.2, and ≥0). As $\in_z$ or $\mu_z$ approaches zero, the pass-band narrows, improving collimation and directivity of the antenna.

Examples of the present invention also include high-gain, low-profile circularly-polarized antennas. Example lenses may be configured to be polarization-insensitive, allowing use in systems that broadcast or receive circularly-polarized transmissions, or for multiplexing multiple data streams onto the same frequency channel. These compact, broadband, polarization-insensitive metamaterials are an important development in the fields of antenna design and communications, in particular space-based communications.

Example apparatus include one or more antennas, such as monopole antennas, embedded in or otherwise proximate to a zero-index or low-index metamaterial. The metamaterial may be a planar metamaterial of one or more layers, and may comprise one or more dielectric substrates. In some examples, conducting elements may be partially or wholly self-supporting. An anisotropic metamaterial may be used to enhance the directivity of directed radiation Metamaterials may also be used as a as superstrate or metamaterial lens for the antenna.

Examples of the present invention include fully 3D anisotropic metamaterials that uses both horizontal and vertical metamaterial elements. A metamaterial may be a generally planar structure, for example as a two-dimensional repeated array of unit cell structures. The unit cell dimensions may be small compared to the operational wavelength, for example $\lambda/5$ or less. The metamaterial may be configured so that there is a good impedance match to the antenna, greatly reducing the reflected energy.

Examples of the present invention include an anisotropic low-index metamaterial structure for a far-field collimating lens, which may be used in conjunction with an antenna feed such as a dual-polarization crossed-dipole antenna feed situated above a metallic ground plane. In some examples, a high impedance ground plane may be included located proximate (e.g. under) an antenna used to receive (and/or transmit) signals. An artificial magnetic conductor may be used to reduce antenna thickness.

Electromagnetic Properties of Metamaterial Lenses

Electromagnetic (EM) properties of anisotropic ZIMs/LIMs, and applications as thin lenses for the purpose of antenna directivity enhancement (beam collimation) are now examined. The lens design process assumes homogeneous materials. A metamaterial is selected to approximate the homogenous structure, and the fabrication and measurement of a prototype device allows comparison with the predicted results. A proposed meta-lens structure comprises uniaxial medium whose effective permittivity and permeability tensors have the form given in (1) below:

$$\bar{\bar{\varepsilon}} = \varepsilon_0 \begin{bmatrix} \varepsilon_T & 0 & 0 \\ 0 & \varepsilon_T & 0 \\ 0 & 0 & \varepsilon_z \end{bmatrix} \tag{1a}$$

$$\bar{\bar{\mu}} = \mu_0 \begin{bmatrix} \mu_T & 0 & 0 \\ 0 & \mu_T & 0 \\ 0 & 0 & \mu_z \end{bmatrix} \tag{1b}$$

The material parameters for the fields along the optical axis ($\in_z$ and $\mu_z$) are different from those for fields along the transverse axes ($\in_T=\in_X=\in_Y$ and $\mu_T=\mu_X=\mu_Y$). The meta-lens is constructed so that its interfaces are normal to the optical axis (z axis) of the uniaxial medium. As a result, the dispersion relations for TE and TM polarized wave propagation inside this medium can be described by Equation (2):

$$\frac{\beta_z^2}{\mu_T} + \frac{\beta_T^2}{\mu_z} = k_0^2 \varepsilon_T \tag{2a}$$

$$\frac{\beta_z^2}{\varepsilon_T} + \frac{\beta_T^2}{\varepsilon_z} = k_0^2 \mu_T \tag{2b}$$

where $k_0$ is the free space wave number. The dispersion relations are useful for determining the wave vector $\beta$ inside the metamaterial, since the tangential component of the wave vector will be conserved at the interface.

In order to evaluate the collimating performance, the transmission and reflection characteristics of the meta-lens under plane wave illumination are studied. Based on the wave propagation vectors derived above, we can compute the fundamental transmission and reflection coefficients at the interface between the metamaterial and surrounding medium. For TE polarized waves obliquely incident upon the slab, the transmission and reflection coefficients ($\tau_1$ and $\rho_1$) can be found by using (3):

$$\tau_1 = \frac{2\mu_T k_z}{\mu_T k_z + \beta_z} \tag{3a}$$

$$\rho_1 = \frac{\mu_T k_z - \beta_z}{\mu_T k_z + \beta_z} \tag{3b}$$

In (3), $k_z$ is the normal component of the wave vector in free space, which is related to the incident angle $\theta_i$ by $k_z=k_0 \cos\theta_i$. Similarly, we can calculate the coefficients ($\tau_2$ and $\rho_2$) at the back surface of the meta-lens as $$\tau_2 = \frac{2\beta_z}{\mu_T k_z + \beta_z} \tag{4a}$$

$$\rho_2 = \frac{\beta_z - \mu_T k_z}{\beta_z + \mu_T k_z} \tag{4b}$$

Consequently, by taking into account the multiple reflections occurring at the front and back surfaces of the meta-lens, we find the transfer function as given in (5).

$$\begin{aligned} T_S &= \tau_1\tau_2\exp(-i\beta_z t) + \tau_1\tau_2\rho_2^2\exp(-3i\beta_z t) + \\ &\quad \tau_1\tau_2\rho_2^4\exp(-5i\beta_z t) + \ldots \\ &= \frac{\tau_1\tau_2\exp(-i\beta_z t)}{1-\rho_2^2\exp(-2i\beta_z t)} \end{aligned} \tag{5}$$

Since the transfer function relates the electric fields at the front and back surfaces of the metamaterial slab, this transfer function may be used to characterize the EM properties of example meta-lens.

FIG. 1 shows a thin metamaterial lens (meta-lens) arrangement comprising a uniaxial low-index metamaterial 10 having lens faces 16 placed above a crossed dipole 12 to improve the broadside directivity. The circularly-polarized crossed-dipole antenna 12 is placed between the lens and a ground plane 14 to create a unidirectional high-gain aperture antenna.

As LIMs are needed for the construction of collimating lenses, the transfer functions of several low-index uniaxial metamaterial slabs were investigated. In all the cases, the transverse components of the permittivity and permeability tensors ($\in_T$ and $\mu_T$) are unity and the thickness of the slab is $0.5\lambda_0$.

Figure 2A:
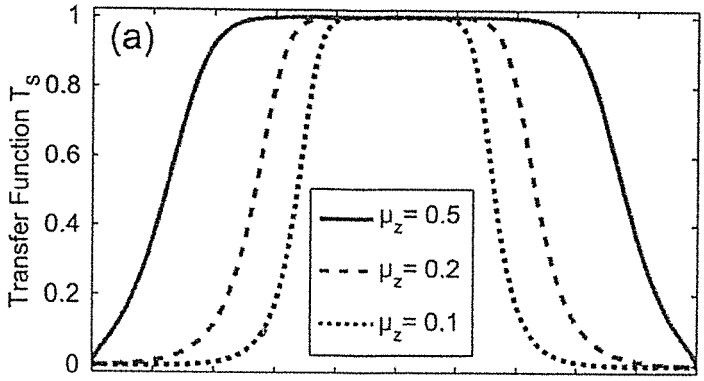
FIG. 2A shows transfer functions of a slab of uniaxial low index metamaterial for TE polarized waves. The transverse permittivity and permeability tensor components ($\in_T$ and $\mu_T$) are all unity and the z component of the permeability $\mu_z$ are 0.5, 0.2 and 0.1.

FIG. 2A shows transfer functions of a slab of uniaxial low index metamaterial for TE polarized waves. The transverse permittivity and permeability tensor components ($\in_T$ and $\mu_T$) are all unity and the z component of the permeability $\mu_z$ are 0.5, 0.2 and 0.1 for the solid, dashed and dotted curves, respectively.

The low-index meta-lens behaves as a low-pass spatial filter for plane wave components with different transverse wave vectors. The angular passband region becomes narrower as $\mu_z$ approaches zero. As a result, waves propagating through such a meta-lens will be concentrated into a narrow cone with collimated propagation normal to the surface of the meta-lens. This effect can be used to enhance the directivity of an antenna that is placed underneath the meta-lens.

Figure 2B:
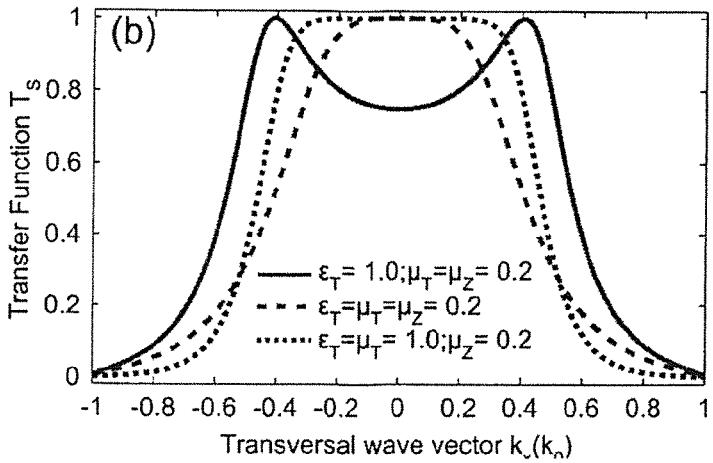
FIG. 2B shows transfer functions of a slab of metamaterial with different combinations of low-index material parameters for TE polarized waves.

FIG. 2B shows transfer functions of a slab of metamaterial with different combinations of low-index material parameters for TE polarized waves, for comparison with the anisotropic low-index meta-lens. The transfer function of an isotropic magnetic metamaterial with permeability less than one but permittivity equal to one (solid line) exhibits a dip for $k_x$ close to zero due the impedance mismatch. This causes reflections for normally incident waves and is undesirable for a lens application. The transfer function of an isotropic metamaterial with low refractive index and matched permittivity and permeability exhibits high transmission for waves at near-normal incidence due to the matched impedance. However, this LIM has poorer stopband roll-off performance compared to the anisotropic meta-lens of FIG. 2. Furthermore, it is more difficult to implement an isotropic metamaterial with matched permittivity and permeability than an anisotropic metamaterial where only one component of the material tensor is controlled.

From the analysis of the behavior of the various low-index meta-lenses, it is apparent that the uniaxial low-index metamaterial lens exhibits superior collimation performance compared to other candidates. Electric and magnetic metamaterials with anisotropic properties can be realized using various subwavelength resonators.

A low-index metamaterial behaves as a low-pass spatial filter for different plane wave components and the pass-band becomes narrower as $\in_z$ or $\mu_z$ approaches zero. As a result, waves propagating through such a metamaterial are collimated and the directivity of an antenna that is placed underneath the metamaterial is enhanced. This configuration allows design of a high-gain low-profile circularly-polarized antenna, compared to a more classical helical antenna.

Example metamaterials possesses low values for both $\in_z$ and $\mu_z$ in order to produce three-dimensional collimated beams. Using a dual dipole antenna source, a balanced response to both dipoles is obtained by using matched material parameters ($\in_z=\mu_z$, $\in_T=\mu_T$) to produce the desired circularly-polarized radiation. In order to prevent energy leakage from the sides of the lens, metal strips were placed around the outer edges of the lens. Any effectively perfect electrical conductor edge (PEC edge) may be used.

Such an anisotropic metamaterial design was found to have better matching and collimation performance compared to an isotropic counterpart. Furthermore, it can be simpler to implement an anisotropic metamaterial where only one component of the material tensor must be controlled than an isotropic metamaterial. Lenses with similar collimation capabilities have also been demonstrated through the coordinate transformation approach. However, the resulting material requirements are usually challenging to achieve in a practical metamaterial and result in limited operating bandwidth. Moreover, some TO designs can even be simplified and realized using homogeneous and anisotropic zero- or low-index metamaterials with comparable device performance.

Metamaterial Design

The design of a matched uniaxial magneto-electric metamaterial can be broken into two separate parts; one for a metamaterial with near-zero z-directed permeability and the other for a near-zero z-directed permittivity. Combining the two components will then produce a metamaterial that can be tuned to have matched and uniaxial effective parameters as required for construction of the collimating meta-lens.

In the microwave regime, printed-circuit board (PCB) fabrication can be used for metamaterial construction, where metallic structures are implemented as planar PCB traces on one or both sides of a dielectric substrate. The conducting structures of the metamaterial molecules are then modeled as infinitely thin perfectly-conducting (PEC) patches on the inside surfaces of hollow dielectric blocks.

Conventional negative index or left-handed metamaterials (NIMs) operate in the resonance region where the permittivity and permeability are simultaneously negative. In contrast, ZIM/LIM lenses according to examples of the present invention function in the high-frequency tail near the zero-crossing of the resonance, where the absorption losses are low with greater achievable bandwidth.

Magnetic Metamaterials

Split ring resonators (SRRs) may be used to manipulate the magnetic properties of metamaterial devices. An electrically conducting loop pattern, which may be formed as printed tracks on a PCB, couples strongly to the normal magnetic field and exhibits an LC resonance. A split ring resonator includes an electrically conducting loop pattern with a gap in the conducting track, sometimes called a capacitive gap. The resonance may be tuned by scaling the gap and loop dimensions. Arrays of SRR elements at resonance produce a Lorenz-Drude effective permeability response that may be used to produce devices with large, small, and negative effective permeability.

Figures 3A, 3B, 3C, 3D, 3E, 3F:
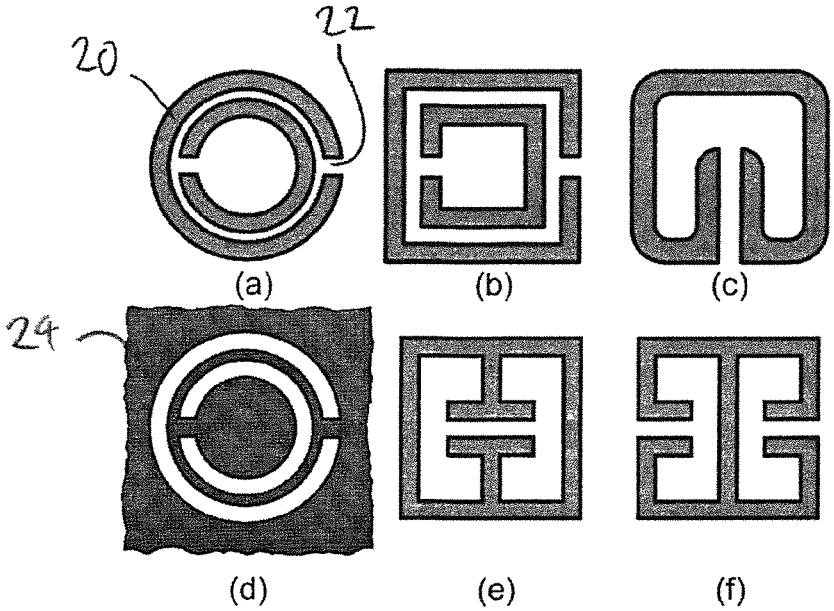
FIGS 3A - 3F (PRIOR ART)
FIGS. 3A-3F show prior art resonators.

FIG. 3A-3C show example prior art split ring resonators. FIG. 3 shows conducting rings 20 with a gap 22. The term ring resonator does not imply a circular conducting loop, and a ring resonator may include square or otherwise shaped conducting loops as illustrated by FIGS. 3B and 3C. However, these SRR structures shown possess only a single line of rotational symmetry, which produces significant bianisotropic effects in a bulk metamaterial.

Figure 4:
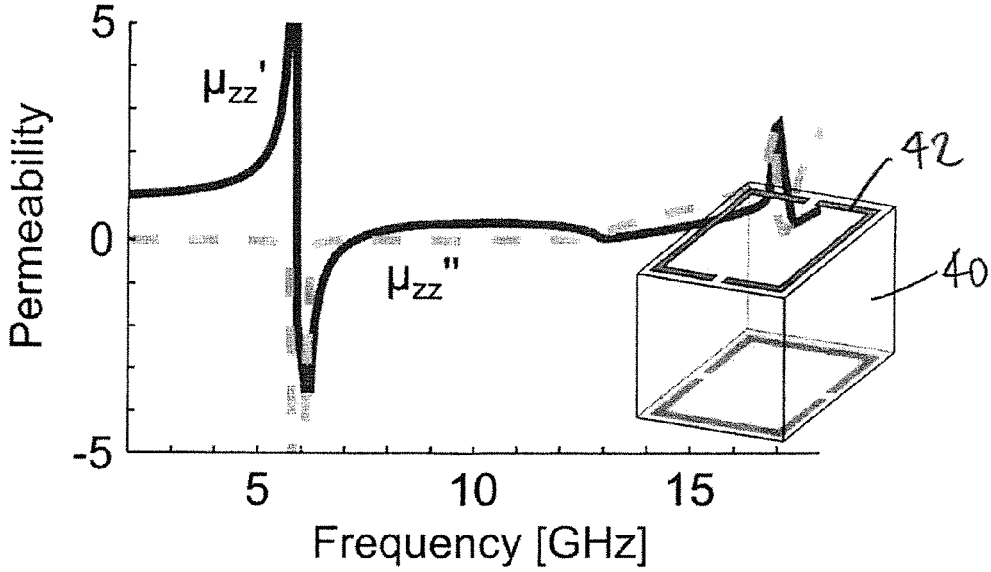
FIG. 4 shows SRR z-oriented permeability dispersion curve, with near-zero low-loss behavior from 7 GHz to 12 GHz.
Figure 6:
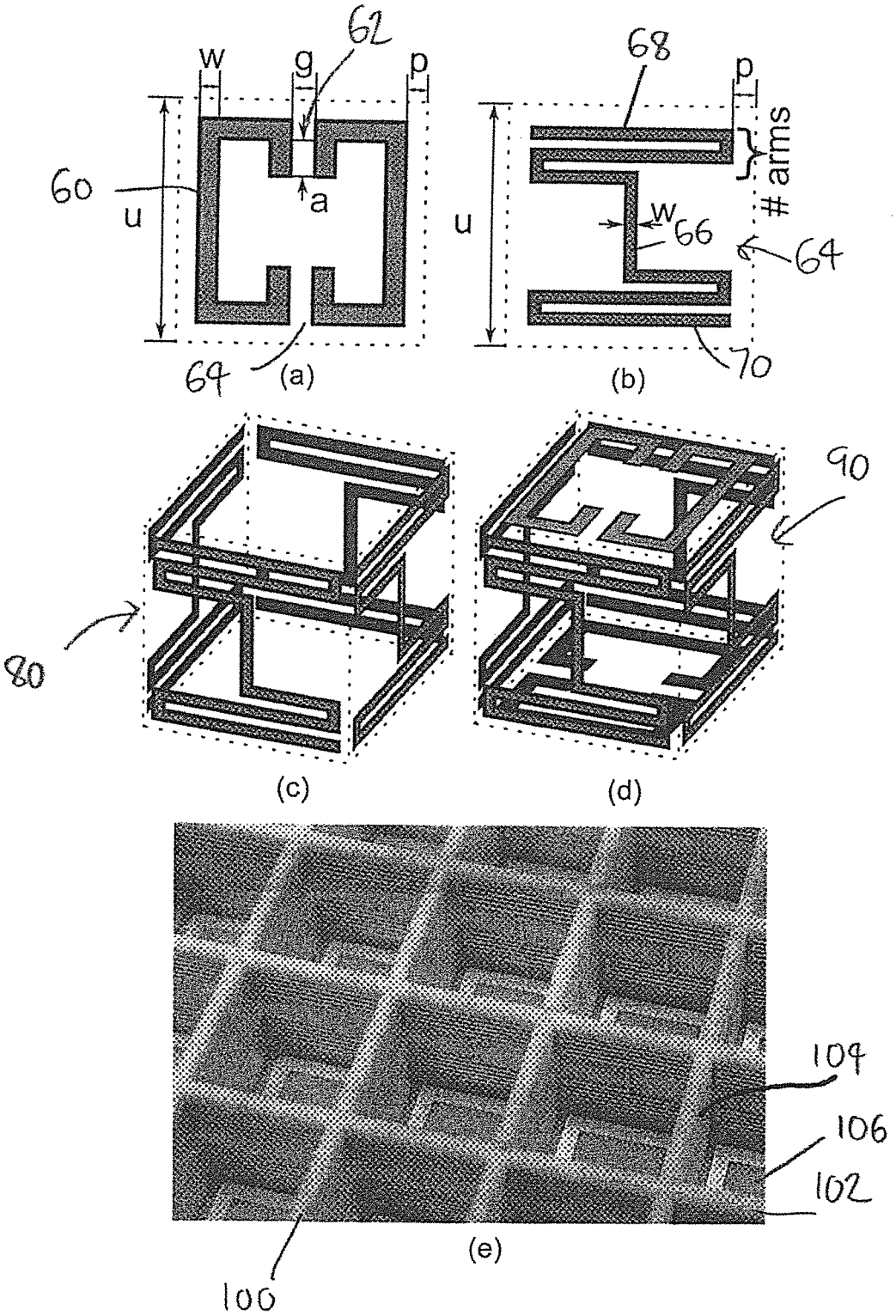
FIGS. 6A-6D show metamaterial configurations, where
FIG. 6E shows a photo of fabricated metamaterial unit cells.
Figure 7:
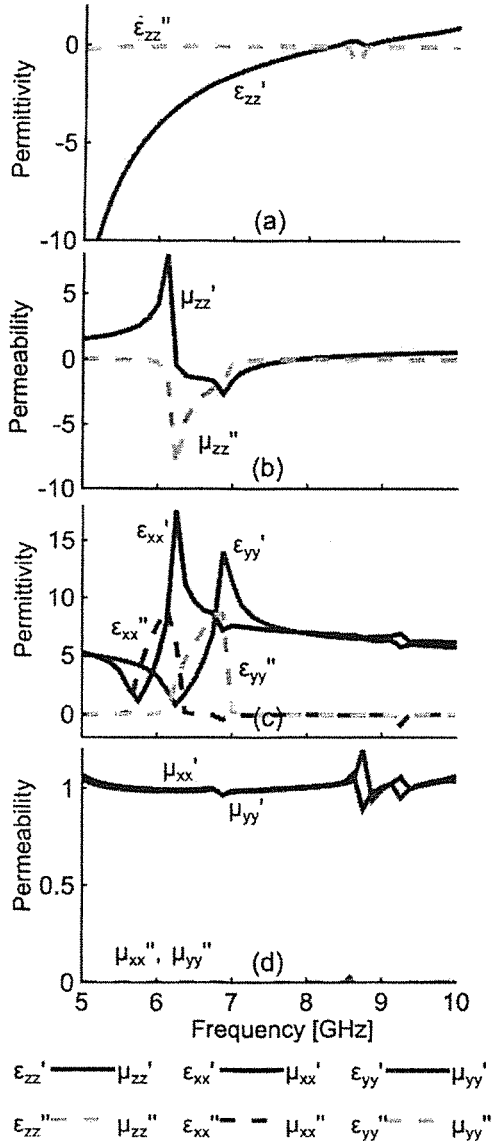
FIGS. 7A-7C shows anisotropic permittivity and permeability of the combined magneto-electric SRR-VELD metamaterial, with FIG. 7A shown normal permittivity, FIG. 7B showing tangential permittivity, FIG. 7C showing normal permeability, and FIG. 7D showing tangential permeability.

A modified split-ring resonator designed for a low-index magnetic material. An example SRR is shown in FIG. 4 (inset, 40) and FIG. 6A (at 60), including first and second gaps oriented 180 degrees from each other. FIG. 4 (inset) shows the ring resonator 42 located on opposed faces of a cubic metamaterial unit cell. The unit cell cube does not necessitate actual physical structure, but may approximate a cube formed by dielectric substrates on which the resonators are supported, on the inner and/or outer surfaces. The resonator may also be termed a dual-split ring resonator (DSRR), referring to the two splits or gaps in the ring structure (FIG. 6A, 62). This SRR has D2 symmetry, allowing dual-polarization applications by eliminating magnetoelectric coupling. To further improve tangential isotropy, two vertically adjacent SRRs in each unit cell are separated by 90 degrees.

Adding a second gap to the SRR decreases capacitance by a factor of two, scales the resonant frequency by a factor of approximately 1.4, and increases the electrical size of the resonator. The SRR is magnetically active for the normally oriented magnetic field, so the array of SRRs is aligned in the x-y plane to promote a z-permeability ($\mu_z$) response. The resonant frequency and associated low-index band are controlled by modifying the capacitance or inductance of the series RLC equivalent circuit. Modifying inductance and/or capacitance through increased resonator area, decreased wire thickness, longer capacitive coupling arms, using surface-mounted components, or reducing the capacitive gap width will decrease the frequency of the LIM band.

The performance of an SRR array was evaluated by modeling a single unit cell in HFSS using periodic boundary conditions, thus simulating an infinite array of elements. The reflection (R) and transmission (T) scattering parameters are then numerically determined for the periodic slab. Assuming that the metamaterial may be treated as a thin, infinite slab of homogeneous material, the scattering coefficients can be inverted using the Fresnel equations to yield the effective permittivity ($\in$) and permeability ($\mu$) parameters for the material. Since these unit cells produce diagonally anisotropic parameters, and each set of scattering parameters for a given polarization and wave incidence direction results in a single $\in/\mu$ pair, three simulations are run to extract all six terms of the permittivity and permeability tensors. Simulations are performed for waves traveling in each of the X, Y, and Z directions through the unit cell.

FIG. 4 shows an SRR z-oriented permeability dispersion curve, showing near-zero low-loss behavior from 7 GHz to 12 GHz. The extracted material parameters from the dual-split SRR array show a resonance in $\mu_{zz}$ that creates a ZIM/LIM condition at ~7 GHz.

Electric Metamaterial

FIGS. 3C-3F show conventional resonators used for electric metamaterials. However, the complementary SRR resonator of FIG. 3D, formed by insulating regions in a conducting region 24, performs poorly in transmission and is not good for dual-polarization applications because of magnetoelectric coupling. The electric LC (ELC) resonators of FIGS. 3E-3F may be used, but are electrically large compared to an SRR of similar amplitude and bandwidth response.

Figure 5:
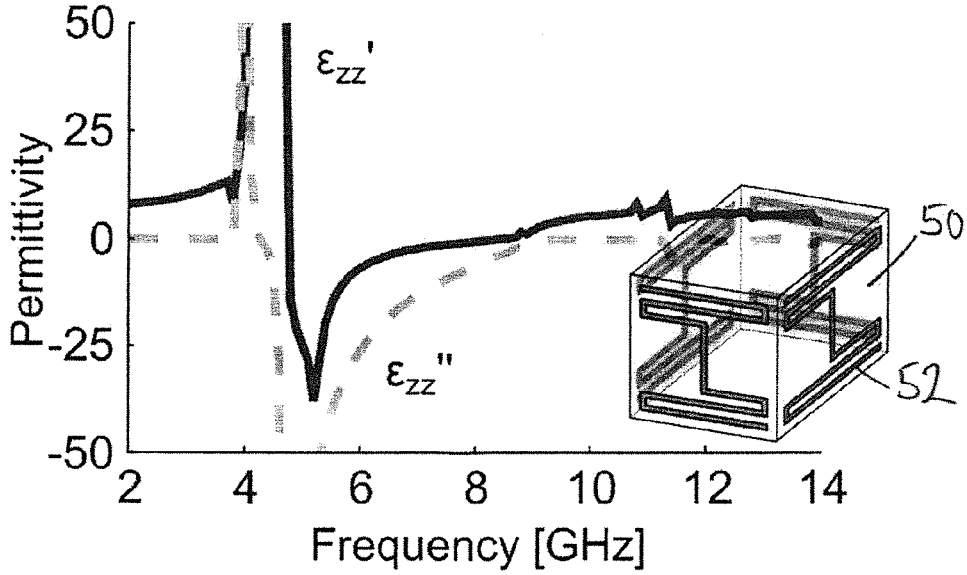
FIG. 5 shows representative VELD z-oriented permittivity dispersion curve, with near-zero values near 8 GHz.

Hence, an improved resonator configuration was designed, denoted an end-loaded dipole. Improved end-loaded dipole resonators are illustrated in FIG. 5 inset at 50 and FIG. 6C generally at 64 include a linear conducting region 66 (FIG. 6B) with sinuous end-loading arms (68, 70) appended at each end of the linear conducting region to create a self-resonant element. Using end-loaded dipole elements creates a more compact resonator with a resonant Lorenz-Drude response. The arms 68, 70 increase the electric field coupling strength of the resonator and allows the number of arms and the spacing between arms to be used as optimization parameters for adjustment of the operational frequency. The resonator illustrated in FIG. 6B is electrically active for electric fields tangential to the surface and oriented parallel to the dipole, so the dipole is z-oriented with the traces in either the x-z or z-y planes.

Combining four vertical (planar) ELD elements creates a 3D volumetric ELD (VELD) unit cell as shown in FIG. 6C generally at 80, for producing a uniaxial z-oriented permittivity with appropriate structure adjustment. The ELD is a chiral resonator with 180° rotational symmetry, but copying the unit cell through rotation to cover each of the four walls to create a racemic configuration that mitigates the chiral effects in a bulk lens. The same modeling approach used for the SRR array was used for simulation of a VELD metamaterial.

FIG. 5 displays the extracted effective material parameters and dimensions of the volumetric ELD (VELD) array, showing a VELD z-oriented permittivity dispersion curve with near-zero values near 8 GHz. FIG. 5, inset, shows four end-loaded dipole resonators 52 disposed on a pair of opposed faces of a cubic unit cell. As for the SRRs, the cubic unit cell shown does not necessitate actual physical structure, but may approximate a cube formed by dielectric substrates on which the resonators are supported on the inner and/or outer surfaces.

FIG. 6A-6E show a split ring resonator, an end-loaded dipole (ELD), a VELD comprising four ELDs, the combined magneto-electric SRR-VELD unit cell geometry, and a photo of fabricated metamaterial unit cells, respectively. FIG. 6A shows the SRR 60 discussed above, having a pair of gaps (such as 62) within opposed portions of the conducting loop structure. FIG. 6B shows the end-loaded dipole (ELD) 64 discussed above. FIG. 6C shows ELDs arranged around four faces of a cube, such as a unit cell or dielectric structure, to form the VELD discussed further above.

FIG. 6D shows the entire unit cell, including a pair of SRRs on opposed faces of the cubic structure, and ELDs arranged around the remaining four faces. FIG. 6D shows the combined cubic metamaterial unit cell 90, comprising two DSRR elements and four ELD structures arranged as a VELD. The unit cells were tuned to achieve roughly simultaneous zero-crossings in both permittivity and permeability near 8 GHz for a low-index operational band from approximately 8 to 9 GHz. Adjacent unit cells are separated by a thin dielectric substrate; in modeling, the metallic patches for each unit cell are treated as being printed on the interior of a hollow dielectric cube. The effective material parameters of the unit cells were determined by first computing the plane-wave scattering coefficients of an infinitely-periodic array of unit cells using periodic boundary conditions in HFSS. FIG. 6E shows a photo of fabricated metamaterial unit cells 100. The fabricated metamaterial unit cells 100 further include a first dielectric substrate 106, a second dielectric substrate 104, and a third dielectric substrate 102.

FIG. 7A-7D show anisotropic permittivity and permeability of the combined magneto-electric SRR-VELD metamaterial, with normal permittivity, tangential permittivity, normal permeability, and tangential permeability, respectively. Equivalent material parameters were extracted for the resonator design using the configuration shown in FIG. 6D. The frequency-dependent curves show the resulting material is uniaxial for both permittivity and permeability in the desired range from 8-9 GHz. However, the desired tangential permittivity goal of $\epsilon_{xx}=\epsilon_{yy}=1$ was not met. The metal strips in the SRR and ELD elements that are tangential to the surface interact with the tangential electric field, contributing to the electric polarizability of the structure and producing Lorenz-Drude resonant behavior.

Simulations of the lens composed of a homogeneous slab with material parameter dispersion taken from unit cell simulations showed that the desired collimating effect was achieved even with non-unity tangential permittivity components.

To demonstrate the collimation effects of the meta-lens, a crossed dipole antenna was placed over (proximate) a ground plane, such as a metallic sheet, and modeled as a perfectly conducting ground plane. When fed with a 90 degree phase offset, the crossed-dipole antenna generates circularly polarized radiation. As shown in FIG. 1, a thin meta-lens made of uniaxial low index metamaterial is placed above the crossed dipole to improve the broadside directivity. The lens was chosen for convenience to be 60 mm square, with cubic unit cells between $\lambda/10$ and $\lambda/7.5$ over the band of interest. This configuration has the potential to achieve high-gain for a linearly polarized as well as circularly polarized antenna with low-profile compared to, for example, more classical antennas such as Yagi or helical antennas. Simulations in Ansoft HFSS of the dipoles elevated approximately $\lambda/4$ above the ground plane show a peak broadside gain of 7.5 dB with −16.4 dB cross-polarized radiation relative to co-polar peak gain. The addition of the lens is expected to increase the gain by approximately 6 dB.

Since the radiated fields from the crossed dipoles contain both TE and TM waves, the meta-lens must possess low values for both $\epsilon_z$ and $\mu_z$ in order to produce collimated beams in both the E and H planes. A balanced response to both dipoles is obtained by using matched material parameters ($\epsilon_z=\mu_z=0.2$, $\epsilon_T=\mu_T=1$) to produce the desired circularly-polarized radiation. The meta-lens is placed above the crossed dipoles with a ground plane underneath. In order to prevent energy leakage from the sides of the lens, metal strips were placed around its outer edges. These metal strips mimic graded material parameters and help guide the waves to propagate forward in the desired direction.

Figures 8A, 8B:
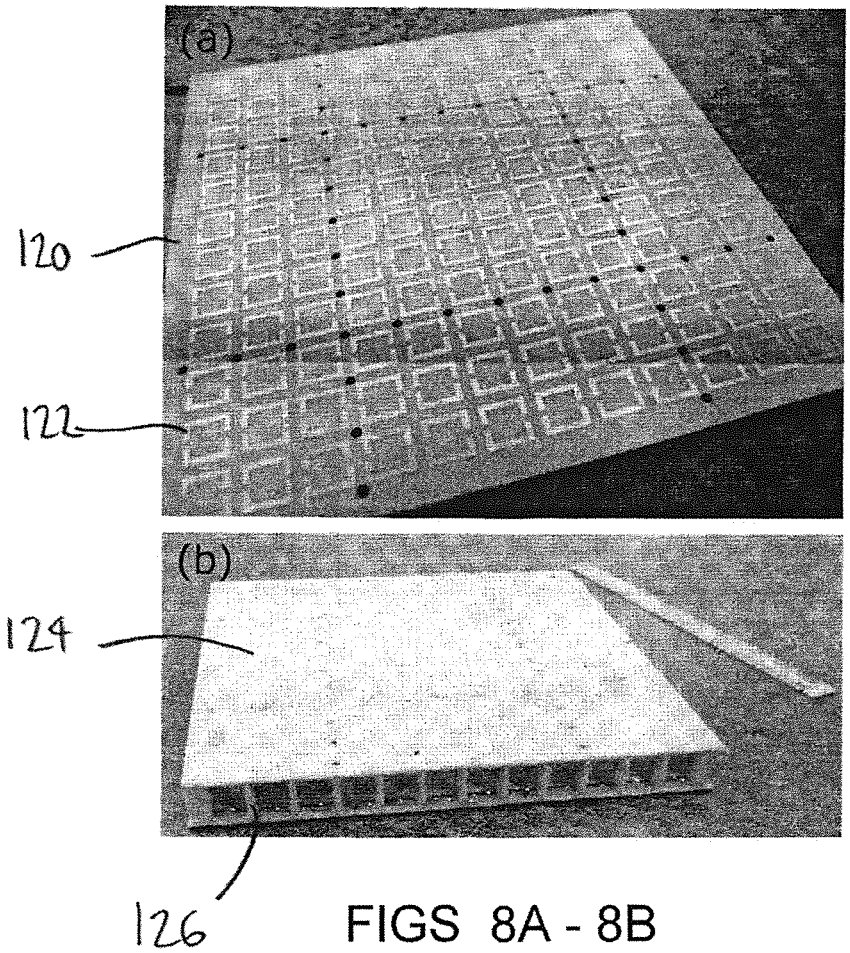
FIG. 8A-8B illustrate a metamaterial lens, with FIG. 8A showing a split-ring resonator panel, and FIG. 8B showing a fabricated lens.

FIGS. 8A and 8B show a meta-lens fabricated using PCB construction techniques. FIG. 8A shows a dielectric substrate 120 supporting an array of dual-split ring resonators (DSRRs) such as 122. FIG. 8B show the completed lens, comprising strips (linear arrays) of vertical ELD elements supported on dielectric substrates such as those seen on edge (126), and similar perpendicular dielectric substrates (124), combined in a wine-crate structure for rigidity and simplicity of assembly. Large square dielectric substrates (panels) supporting SRR elements form to the top and bottom of the lens. The illustrated top surface of the lens is the opposite face of the dielectric substrate shown at 120, the DSRRs being supported on the interior surface. The bottom face of the lens is similar to the top face, as illustrated.

Notches in the ELD strips allowed the creation of a square grid with oppositely-oriented strips assembled at right-angles. To ensure accurate placement of the SRR panel, an array of holes was drilled to correspond to pegs located on the top and bottom of the ELD strips. The exterior transverse edges of the lens were secured with small quantities of epoxy, but no adhesive was used inside the lens structure to prevent changes to the metamaterial behavior. The metal features were printed on 20 mil Rogers 4003 dielectric substrate (Rogers Corp, Rogers, Conn.) with dimensions adjusted to yield a low-index metamaterial operating band from 6.5 to 7.75 GHz. A 19.6 mm coax-fed half-wave dipole antenna with a 20 mm coaxial taper balun was constructed and trimmed for resonance at 7 GHz in the free space to obtain a good impedance match.

Figure 9:
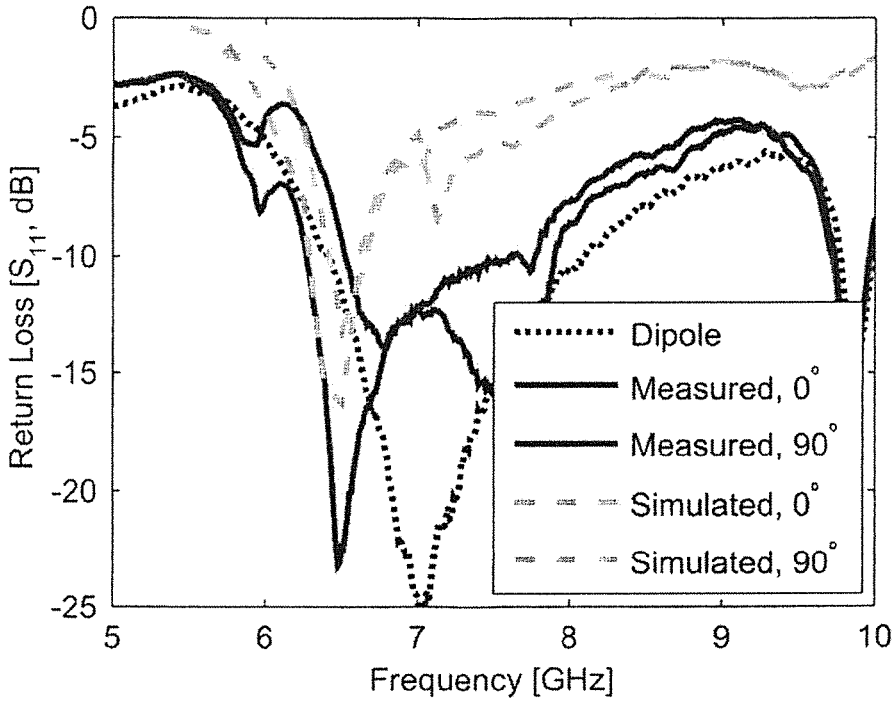
FIG. 9 shows the return loss of the dipole alone compared to measurements of the lens and antenna fed with an impedance-matching cylindrical-taper balun.

FIG. 9 shows the return loss of the dipole alone compared to measurements of the lens and antenna fed with an impedance-matching cylindrical-taper balun. The balun significantly improves the impedance match and available bandwidth of the dipole-lens combination compared with the simulated predictions, giving the wide bandwidth of the single dipole.

Figure 10:
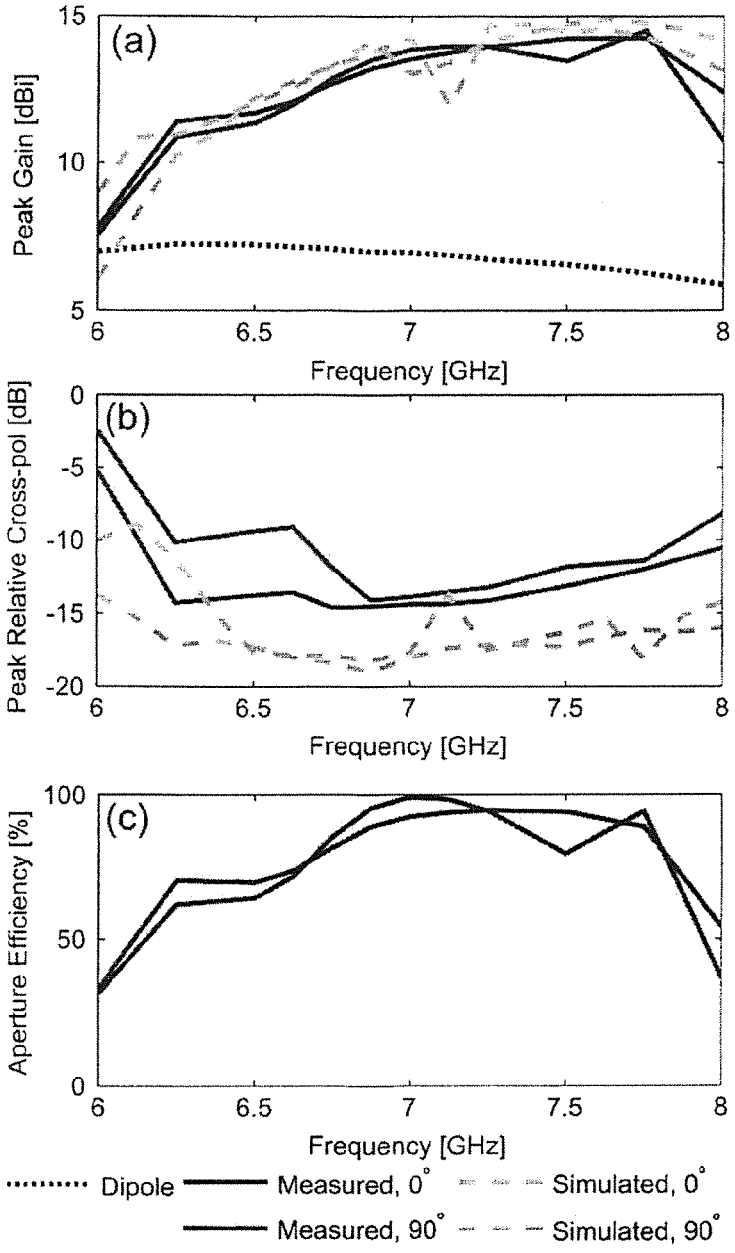
FIG. 10A shows the realized gain of the meta-lens antenna system for both polarizations, where the antenna configuration shows significant gain improvements over the dipole alone.
FIG. 10B shows the effective aperture efficiency of the meta-lens system for both polarizations, assuming the energy is radiated from the 60 mm square lens aperture, with the antenna having very high aperture efficiency.
Figure 11:
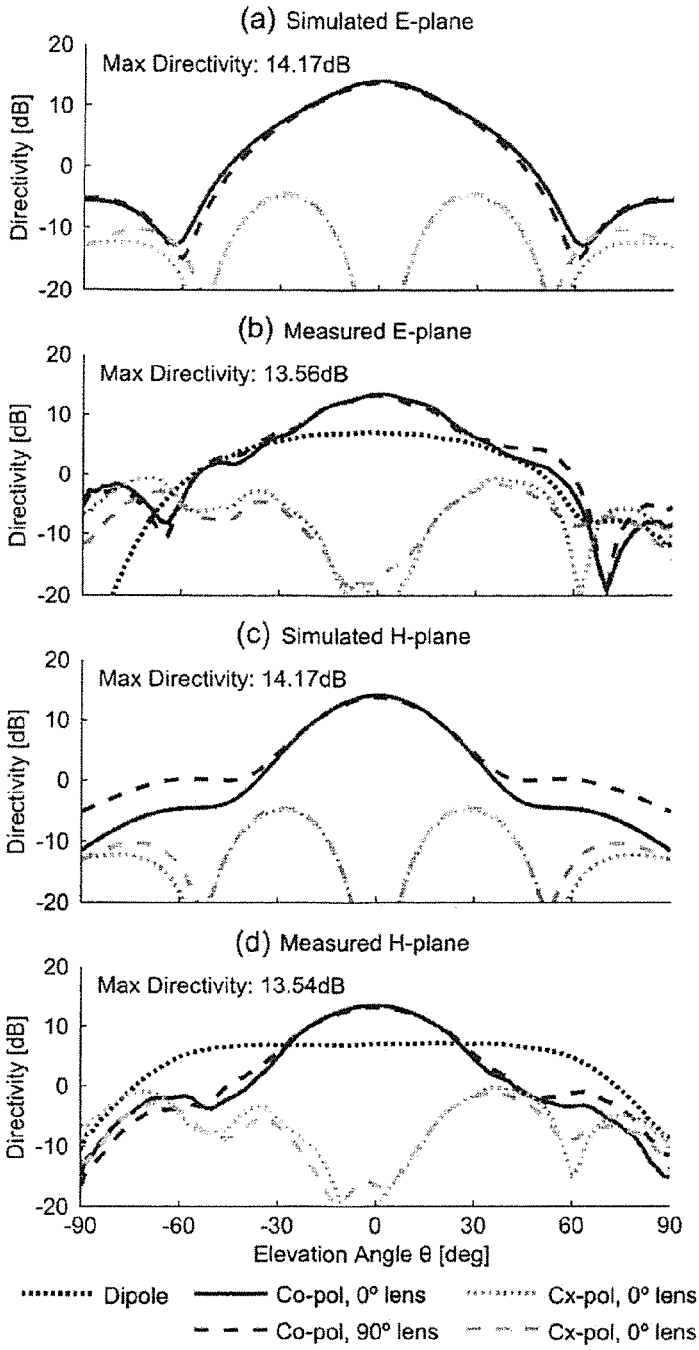
FIGS. 11 and 12 show measured and simulated linearly-polarized E- and H-plane radiation patterns of a fixed linear dipole antenna for two orthogonal orientations of the lens.
Figure 12:
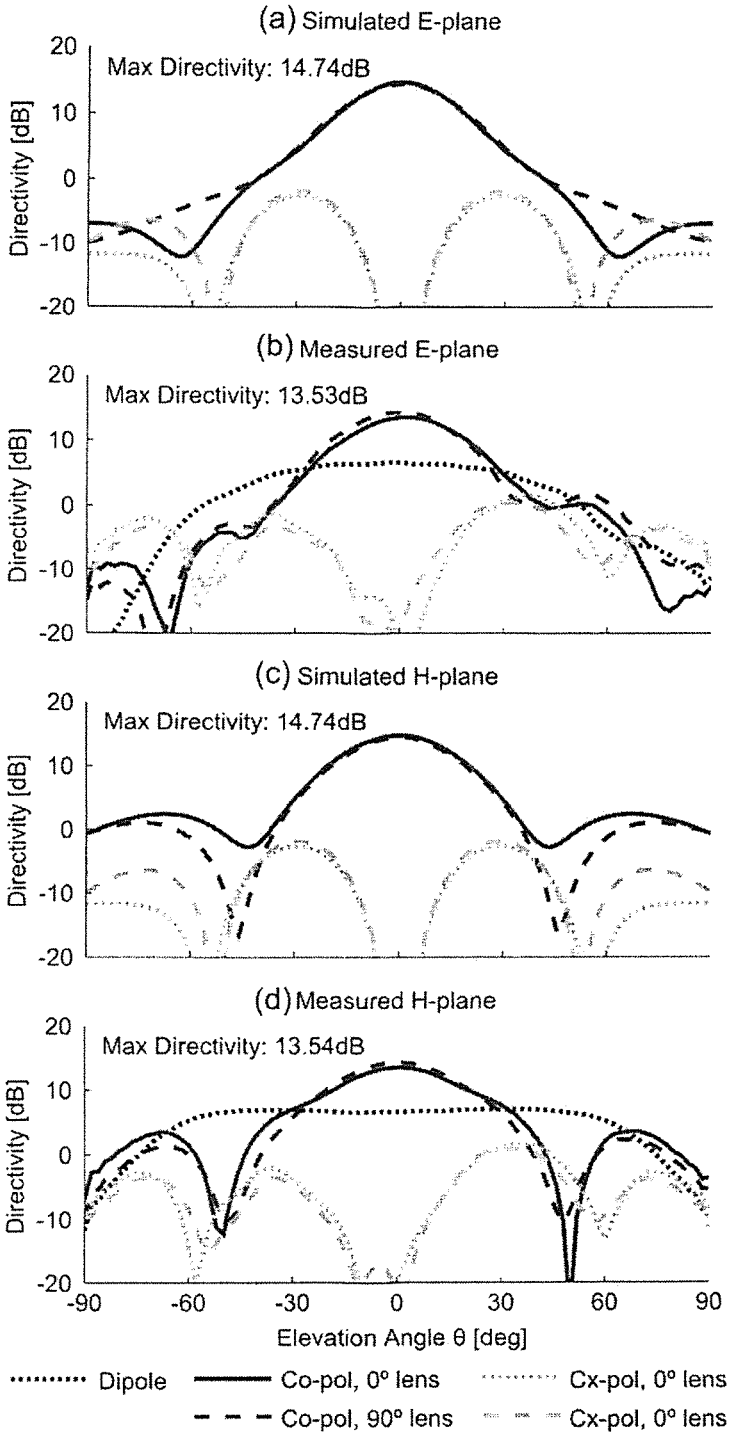

FIGS. 10A-10C shows the peak gain, peak relative cross-polarization, and aperture efficiency, respectively. The figures show the realized gain of the meta-lens antenna system for both polarizations, with the antenna showing significant gain improvements over the dipole alone. The effective aperture efficiency of the meta-lens system for both polarizations assumes the energy is radiated from the 60 mm square lens aperture. The system has very high aperture efficiency. The gain shows significant improvement over the dipole alone across the measurement band from 6 to 8 GHz, with the best performance from 6.75 to 7.75 GHz yielding 15% useful bandwidth. The gain is greater than 80% over the same 6.75 to 7.75 GHz range and greater than 90% between 6.875 and 7.125 GHz. The high aperture efficiency is due to the uniform phase and amplitude distribution created by the meta-lens.

FIGS. 11A-11D and 12A-12D show linearly-polarized E-plane and H-plane radiation patterns, both measured and simulated, for a fixed linear dipole antenna for two orientations of the lens (0° and 90°), to demonstrate polarization independence of the meta-lens. FIG. 11 shows simulated and measured E and H plane radiation pattern cuts for both 0° and 90° lens rotation at 6.875 GHz. The measured and simulated patterns show good agreement with a small decrease in measured directivity compared to simulations, and the patterns are identical in the main beam for both rotations of the lens, showing good dual-polarization performance. FIG. 12 shows simulated and measured E and H plane radiation pattern cuts for both 0° and 90° lens rotation at 7.5 GHz. The patterns are very similar in the main beam for both rotations of the lens, showing good dual-polarization performance. The measured patterns have some gain drop-off compared to the simulations.

The radiation patterns from the two lens orientations show minimal differences, indicating that the lens performs equally well for both incident linear polarizations and has excellent performance with circularly-polarized systems. Measured and simulated radiation patterns are representative of performance and simulation/measurement agreement over the entire band. The antenna has a pattern and impedance bandwidth of over 0.7 GHz (i.e. over 10% bandwidth, relative to an operational frequency in the center of the band). The minor disagreements between the measured and simulated patterns are due to small discrepancies in the manufacturing process.

Figure 13:
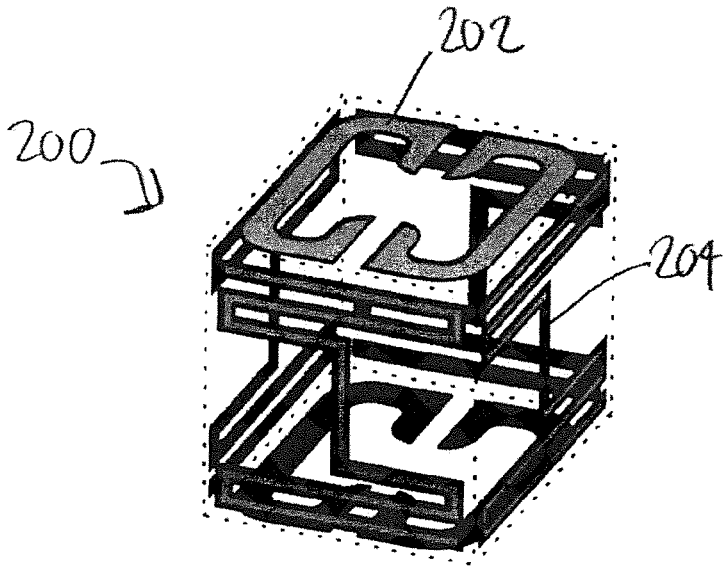
FIG. 13 illustrate metamaterial unit cell structures used for example metamaterial lenses.

FIG. 13 illustrates another example metamaterial unit cell structure, as a combined magneto-electric metamaterial unit cube 200, similar to that of FIG. 6D, used for a meta-lens. A dual-split ring resonator (DSRR 202, shown with parameterized dimensions) and end-loaded dipole (ELD 204) element (shown with parameterized dimensions) are combined in a 3D volumetric ELD (VELD) unit cube composed of four rotated ELD structures and two split ring resonators. As discussed above, a modified split-ring resonator may be used for the implementation of a low permeability magnetic material. The metamaterial unit cell may comprise dual-split ring resonators (DSRRs) with parameterized dimensions, and end-loaded dipole (ELD) elements with parameterized dimensions, arranged in a 3D volumetric ELD (VELD) unit cube comprising four rotated ELD structures. One or more ring resonators and one or more end-loaded dipoles may be combined into magneto-electric metamaterial unit cube.

The illustrated cube may be a unit cell, approximation thereof, or representative of a dielectric cube formed by dielectric sheets used as dielectric substrates. A dielectric cube may be formed by three pairs of parallel, spaced apart, dielectric substrate, each pair being perpendicular to the two other pairs. The spacing of each pair of dielectric substrates is the same, so that the intersection of the substrates forms the dielectric cubes. Each face of the cube may include a single resonator of an array of resonators.

The end-loaded dipole (ELD) illustrated in FIG. 13 was used to realize a low permittivity electrically active material. Combining four vertical ELD elements creates a volumetric ELD (VELD) for producing a uniaxial z-oriented permittivity with appropriate structure adjustment. The combined cubic metamaterial unit cell comprises two split-ring resonator elements and four ELD structures arranged as a VELD. In other examples, the unit cell may be cuboid.

The unit cells were tuned to achieve roughly simultaneous zero-crossings in both permittivity and permeability near 8 GHz for a low-index operational band from approximately 8 to 9 GHz. In the microwave regime, printed-circuit board (PCB) fabrication is a good solution for metamaterial construction, where metallic structures are implemented as planar PCB traces on one or both sides of a dielectric substrate. The resulting material is uniaxial for both permittivity and permeability in the desired range and satisfies the example design goal.

Table I and II below give dimensions of an example metamaterial design for use in the 8-9 GHz band. Table I shows example metamaterial unit cell parameters for a dual split-ring resonator. Table II shows example metamaterial unit cell parameters for a volumetric end-loaded dipole. These parameters are exemplary, and may be scaled for application at other frequencies.

TABLE I

| Dual-Split-Ring Resonator | | | | |
|---|---|---|---|---|
| u | P | w | g | a |
| 5 mm | 0.508 mm | 0.508 mm | 0.65 mm | 0 mm |

TABLE II

| Volumetric End-Loaded Dipole | | | |
|---|---|---|---|
| u | p | w | # arms |
| 5 mm | 0.354 mm | 0.127 mm | 6 |

To demonstrate the collimation performance, a 60×60×5 mm metamaterial comprising designed cubical unit cells was simulated using HFSS. A crossed-dipole antenna over a ground plane without a lens produces radiation patterns with a peak gain of 9.5 dB at 8.3 GHz.

FIGS. 14A-14B show a simulated 2D radiation pattern of a metamaterial lens fed by single x-polarized dipole at 8.3 GHz. The dipole with lens has 6 dB greater gain than the crossed dipoles without the lens. FIG. 14A show E- and H-plane co-polarized radiation pattern cuts, and 45 degree cross-polarized radiation pattern cut. The cross-polarization is negligible over the E- and H-planes. FIG. 14B shows the 3D co-polarized radiation pattern. By optimizing antenna parameters such as the height of the metamaterial and crossed dipoles above the ground plane, the lens improves the gain over the isolated dipoles by 6 dB without introducing excessive cross-polarized fields, as shown.

Loss in the lens is also low across the entire operational band. The operational bandwidth of the lens is partially determined by the return loss; between 8 to 9 GHz, the return loss is less than −10 dB, indicating that the majority of the energy is radiated between those frequencies.

Metamaterials comprising of anisotropic low-index metamaterials can be used to improve the broadside directivity of crossed dipole and other antennas and provide a new way to construct compact highly-directive antennas. A uniaxial low-index collimating lens was implemented with cubic unit cells using a combination of split-ring resonators and end-loaded dipoles within metamaterial unit cells.

Example metamaterial designs exhibited useful collimating behavior, with acceptable reflection losses over a 12% bandwidth centered at 8.3 GHz.

Applications

Examples of the present invention include compact high-directivity polarization-insensitive antennas with low mass and volume for use in space-based satellites and other communication systems. Example lens structures may be placed at the aperture of a common, low-directivity antenna in order to collimate the outgoing radiation into a narrow, concentrated beam. Hence, a metamaterial lens may be used to create a larger effective aperture, without a requirement to physically enlarge the real aperture. The larger effective aperture produces higher directivity radiation. In most applications, the antenna may focus in the far-field. Applications also include broad bandwidth antennas for multiple-use antennas and multi-band communication systems.

Antennas according to examples of the present invention are useful for aerospace communication systems, including space-based or airborne antennas, or other applications with mass and volume requirements on the antenna design Some examples include metamaterials having a unit cell structure including at least one end-loaded dipole. An end-loaded dipole structure may be used to obtain a desired metamaterial property, such as low permittivity (e.g. a permittivity less than 1, and in some examples less than 0.5 or 0.1 at an operating frequency). As illustrated in FIGS. 6D and 13, an end-loaded dipole may comprise a generally linear central portion having first and second ends, and a sinuous or meandering end portion electrically connected to each end of the central linear portion. The length of the central linear portion may be at least 20% of the unit cell dimension, such as at least 25% or at least 33%. The meandering portion may include a number of arms, and each arm may be a generally linear or curved (e.g. sinusoid portion) along a direction perpendicular to the central portion. The number of arms (e.g. the number of linear portions generally perpendicular to a central portion) may be in the range 1-20, in particular 2-10, such as 2-5. The arm length (e.g. u-2 p in FIG. 13 for a square unit cell in the illustrated plane) may be at least 50% of the unit cell parameter (u), such as at least 75% or at least 80%.

An end-loaded dipole may be formed as a printed conducting track on a dielectric substrate. The track width (w in FIG. 13) may be less than 10% of the unit cell parameter, such as less than 5%. These examples are non-limiting.

In other examples, different end-loaded dipole structures may be used, including different configurations of the end-loaded portions, for example including circular, spiral, sinusoidal, disk-shaped or other form of end-loading structure. In some examples, other dipole elements may be used to obtain the desired antenna properties.

Examples of the present invention include metamaterial lenses configured as far-field collimating lens, in particular for use with a circularly-polarized crossed-dipole antenna. A metamaterial may be constructed as a 3D-volumetric metamaterial slab. Zero and low index metamaterials allow the magnitude and phase of the radiated field across the face of the lens to be distributed uniformly, increasing the broadside gain over the feed antenna alone. A fabricated meta-lens increased the measured directivity of a crossed-dipole feed antenna by more than 6 dB, in good agreement with numerical simulations.

Examples include an anisotropic low-index metamaterial structure, used as a far-field collimating lens with an antenna feed such as a dual-polarization crossed-dipole antenna feed. The metamaterial is uniaxial, and has low values for both $\in_z$ and $\mu_z$ that produce 3D collimated beams. A balanced response to both dipoles may be obtained using $\in_z=\mu_z$, $\in_T=\mu_T$. The metamaterial uses dual-split ring resonators (DSRR) in the x-y plane (that of the lens faces for a slab shaped lens) for a low permeability response, and end-loaded dipole (ELD) elements in the x-z and y-z planes for a low permittivity response over an operational frequency range. As $\in_z$ or $\mu_z$ approaches zero, the pass-band narrows, improving collimation and directivity of the antenna. In particular, examples include a high-gain, low-profile circularly-polarized antenna using a metamaterial lens.

Modifications and variations of the present invention are possible in light of the above teachings and may be practiced otherwise than as specifically described while within the scope of the appended claims.

The invention is not restricted to the illustrative examples described above. Examples described are not intended to limit the scope of the invention. Changes therein, other combinations of elements, and other uses will occur to those skilled in the art.

Having described our invention, we claim:

1. An apparatus, the apparatus being a metamaterial lens having an operating frequency, the metamaterial lens having lens faces, the lens faces being planar, parallel, and spaced apart by a lens thickness, the metamaterial lens including split-ring resonators arranged in resonator arrays, the resonator arrays being parallel to the lens faces, the metamaterial lens further including end-loaded dipoles arranged in end-loaded dipole arrays, the end-loaded dipole arrays being perpendicular to the lens faces.

2. The apparatus of claim 1, the split-ring resonators being dual-split ring resonators, each dual-split ring resonator having two gaps in a conducting loop structure.

3. The apparatus of claim 1, the end-loaded dipoles being configured as volumetric end-loaded dipoles, each volumetric end-loaded dipole being formed by four end-loaded dipoles in a square arrangement, the four end-loaded dipoles consisting of two pairs of spaced apart end-loaded dipoles, the volumetric end-loaded dipole and a pair of split-ring resonators together having a cubic arrangement.

4. The apparatus of claim 1, the split-ring resonators and end-loaded dipoles being configured so that the metamaterial lens has a permittivity $\in_z$ and a permeability $\mu_z$ at the operating frequency, where $\mu_z$ is the permeability along a direction normal to the lens faces, $\in_z$ is the permittivity along a direction normal to the lens faces, and $\in_z$ and $\mu_z$ are both positive and less than 1.

5. The apparatus of claim 1, the operating frequency being in the range 1 GHz-100 GHz.

6. The apparatus of claim 5, the operating frequency being in the range 1 GHz-20 GHz.

7. The apparatus of claim 1, the apparatus comprising a three-dimensional arrangement of dielectric substrates supporting the split-ring resonators and the end-loaded dipoles, the split-ring resonators and the end-loaded dipoles being conducting patterns formed on the dielectric substrates, the three-dimensional arrangement of dielectric substrates defining a plurality of hollow dielectric cubes, a dielectric cube of the plurality of hollow dielectric cubes supporting a pair of split ring resonators, spaced apart and supported on opposed faces of the dielectric cube, the dielectric cube further supporting end-loaded dipoles supported on the other faces of the dielectric cube.

8. The apparatus of claim 1, each end-loaded dipole including a conducting track having a first end and a second end, a first sinuous end-loading arm electrically connected to the first end, and a second sinuous end-loading arm electrically connected to the second end.

9. An apparatus, the apparatus comprising a metamaterial lens having a pair of lens faces, the lens faces being planar, spaced apart, and parallel to each other, the metamaterial lens including:

a first array of dual-split ring resonators, supported by a first dielectric substrate disposed parallel to the lens faces;

a first array of end-loaded dipoles, supported by a second dielectric substrate disposed perpendicular to the lens faces; and a second array of end-loaded dipoles, disposed on a third dielectric substrate disposed perpendicular to both the first and second dielectric substrates.

10. The apparatus of claim 9, the apparatus further including a ground plane and an antenna feed, the ground plane being spaced apart from and parallel to the metamaterial lens, the antenna feed being located between the ground plane and the metamaterial lens, the apparatus being an directional antenna, the antenna feed having an operating frequency, the metamaterial lens being configured so that the metamaterial lens collimates radiation from the antenna feed at the operating frequency.

11. The apparatus of claim 10, the antenna feed being a dual-polarization crossed-dipole antenna feed.

12. The apparatus of claim 10, the directional antenna being a circularly polarized antenna.

13. The apparatus of claim 10, the metamaterial lens having values of $\in_z$ and $\mu_z$ that are both less than 1 at the operating frequency, where $\in_z$ is a permittivity along a direction normal to the lens faces, $\mu_z$ is a permeability along a direction normal to the lens faces.

14. The apparatus of claim 10, the metamaterial including a volumetric end-loaded dipole arrangement configured to provide the metamaterial lens with a uniaxial permittivity at the operating frequency.

* * * * *